US005519418A

United States Patent [19]

Nishikawa et al.

[11] Patent Number: 5,519,418

[45] Date of Patent: May 21, 1996

[54] RECORDING APPARATUS AND METHOD WITH COMPARISON OF CALCULATED AND ACTUAL INK USE

[75] Inventors: Naoyuki Nishikawa, Kawasaki; Fumihiro Tanaka, Yono, both of Japan

[73] Assignee: Canon Kabushiki Kaisha, Tokyo, Japan

[21] Appl. No.: 135,450

[22] Filed: Oct. 13, 1993

[30] Foreign Application Priority Data

Oct. 14, 1992 [JP] Japan ..... 4-276317

[51] Int. Cl.[6] ..... B41J 29/393

[52] U.S. Cl. ..... 347/19; 347/23; 355/208; 355/246

[58] Field of Search ..... 347/7, 19, 23, 347/30, 33, 87; 355/208, 246

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,973,993 | 11/1990 | Allen . | |
| 4,977,413 | 12/1990 | Yamanaka et al. | 347/7 |
| 5,049,898 | 9/1991 | Arthur et al. | 347/19 |
| 5,132,711 | 7/1992 | Shinada et al. | 347/19 |
| 5,136,305 | 8/1992 | Ims . | |
| 5,382,969 | 1/1995 | Mochizuki et al. | 347/23 |

FOREIGN PATENT DOCUMENTS

| | | | |
|---|---|---|---|
| 0443245 | 8/1991 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 1120352 | 5/1989 | Japan . | |
| 1195049 | 8/1989 | Japan . | |
| 1290431 | 11/1989 | Japan . | |
| 3-240058 | 11/1991 | Japan | 347/7 |
| 3-247456 | 11/1991 | Japan | 347/7 |
| 4007158 | 1/1992 | Japan . | |

*Primary Examiner*—John E. Barlow, Jr.

*Attorney, Agent, or Firm*—Fitzpatrick, Cella, Harper & Scinto

[57] ABSTRACT

A recording apparatus has a recording head and a container for ink to be supplied to the recording head. An amount of ink expected to be used in the recording of image data is calculated. The amount of ink actually used in the recording is detected. Comparison of the expected amount of ink used with the actual amount permits a determination whether abnormal recording has occurred.

8 Claims, 12 Drawing Sheets

WHEN READING

WHEN WRITING

RECORDING APPARATUS AND METHOD WITH COMPARISON OF CALCULATED AND ACTUAL INK USE

BACKGROUND OF THE INVENTION

1. Field of the Invention

The present invention relates to a recording apparatus and recording method for recording by enabling a colorant such as ink or toner to adhere to a recording medium.

2. Related Background Art

In a recording apparatus, it has hitherto been known that a colorant container (hereinafter referred to as cartridge) which contains ink, toner, or some others, namely, a colorant for recording on a recording medium, is detachably mounted in the main body of a recording apparatus, and that when the colorant is used up while in recording, the cartridge is replaced by a new one. There are various kinds of cartridges in this respect, thus necessitating the control of the main body of the recording apparatus to change depending on the kind of a cartridge to be mounted in it. As a result, the outer contour of the cartridge is arranged to vary per kind of cartridge as means to provide the main body of the recording apparatus with the information inherent to the cartridge such as its kind and characteristic properties. Thus, when a particular cartridge is mounted, a microswitch or some other controlling means arranged in the main body of the recording apparatus is allowed to be actuated for the implementation of such a control required for the apparatus.

Also, a level sensor is installed in a cartridge, and the information from this level sensor is output to the main body of the apparatus for the provision of the information regarding the colorant remains in the cartridge.

In the meantime, in an ink jet recording apparatus which records on a recording medium by discharging ink on it from the discharging ports, there are some cases that the ink discharging is locally or totally disabled due to the clogging of the discharging ports, the insufficient supply of ink to the discharging ports among others. Therefore, in an ordinary ink jet recording apparatus, a recovery device and others are arranged to keep the discharging ports and its circumference clean. If any trouble such as mentioned above occurs, a recovery process is executed by the recovery device and others.

Nevertheless, the ink jet recording apparatus cannot detect any information regarding the defective ink discharging due to the clogging of the discharging ports or the insufficient supply of ink to the discharging ports. It is, therefore, necessary for the user to detect this visually only in accordance with the recorded medium which has actually been output. Thus, the following problems are inevitably encountered:

(1) When the clogging of the discharging ports is not serious, the defect brought about by this clogging appears only on a limited part of the recorded image. Therefore, the user may easily overlook it when observing the recorded image at a glance.

(2) In a color image recording apparatus, when the recorded color is not the same as the one specifically designated, it is impossible to determine immediately whether the designated color is wrongly taken for recording or such a recorded color is brought about by an abnormality occurring in the apparatus.

(3) Particularly, when a recording on a plurality of sheets is to be executed in succession, there is a possibility that a large amount of recording medium will be wasted eventually if the user does not notice any defective ink discharge while in recording, and the recording is continuously executed to the end as it is.

SUMMARY OF THE INVENTION

It is an object of the present invention to provide a recording apparatus and a recording method capable of automatically determine whether there is any abnormality in the recorded image or not.

It is another object of the present invention to provide a recording apparatus and a recording method capable of automatically control the execution of a recovery process for the recording head when any abnormality is detected in the recorded image.

It is still another object of the present invention to provide an ink jet recording apparatus which uses a recording head for enabling a colorant to adhere to a recording medium, and a colorant container which contains the colorant to be supplied to the recording head in order to execute the adhesion of the colorant on the recording medium in accordance with image information data, comprising:

means for calculating an expected amount of a colorant to be used in accordance with a given amount of image information data;

colorant amount detecting means for detecting the colorant amount in the colorant container; and determining means for determining whether there is any abnormality in a recorded image or-not by comparing the expected amount of the colorant to be used, which is calculated by the calculating means, with the colorant amount actually used for recording which is obtained on the basis of the colorant amount detected by the colorant amount detecting means.

It is a further object of the present invention to provide a method for determining whether there is any abnormality in an image recorded by the recording apparatus which uses a recording head for enabling a colorant to adhere to a recording medium, and a colorant container which contains the colorant to be supplied to the recording head in order to execute the adhesion of the colorant on the recording medium in accordance with image information data, comprising the following steps of:

calculating the expected amount of the colorant to be used in accordance with a given amount of image information data;

detecting the colorant amount in the colorant container; and determining whether there is any abnormality in a recorded image or not by comparing the expected amount of the colorant to be used, which is calculated in the preceding step, with the colorant amount actually used for recording which is obtained on the basis of the detected colorant amount.

It is still a further object of the present invention to provide an ink jet recording apparatus which uses a recording head having the discharging ports which discharge ink toward a recording medium, and an ink container which contains the ink to be supplied to the recording head in order to discharge the ink from the discharging ports in accordance with image information data, comprising:

means for calculating an expected amount of ink to be used by the ink discharge from the discharging ports in accordance with a given amount of image information data;

ink amount detecting means for detecting the ink amount in the ink container;

recovery processing means for executing the recovery process of the ink discharging conditions of the recording head;

determining means for determining whether there is any abnormality in a recorded image or not by comparing the expected amount of the ink to be used, which is calculated by the calculating means, with the ink amount actually used for recording which is obtained on the basis of the ink amount detected by the ink amount detecting means; and control means for determining whether there is any possibility that the ink discharging conditions can be recovered by use of the recovery processing means or not when the determining means has found an abnormality in the recorded image, and then, resuming the image recording subsequent to the operation of the recovery process if the conditions are found recoverable or executing no operation of any recovery process nor executing any image recording if the conditions are found unrecoverable.

It is another object of the present invention to provide an ink jet recording method using a recording head having the discharging ports which discharge ink toward a recording medium, and an ink container which contains the ink to be supplied to the recording head in order to discharge the ink from the discharging ports in accordance with image information data, comprising the following steps of:

calculating an expected amount of ink to be used by the ink discharge from the discharging ports in accordance with a given amount of image information data;

detecting the ink amount in the ink container;

determining whether there is any abnormality in a recorded image or not by comparing the expected amount of the ink to be used, which is calculated in the preceding step, with the ink amount actually used for recording which is obtained on the basis of the detected ink amount;

determining whether there is any possibility or not that the ink discharging conditions can be recovered by the application of the recovery process when it has been found that there is an abnormality in the recorded image; and resuming the image recording subsequent to the operation of the recovery process if the conditions are found recoverable or executing no operation of any recovery process nor executing any image recording if the conditions are found unrecoverable.

According to the present invention, it is possible for the recording apparatus to provide the information of whether there is any abnormality in the recorded image with respect to the quality of the recorded medium, making it unnecessary for the user to exercise his visual recognition which is otherwise required for him to make regarding the recorded conditions of the recording medium, thus eliminating also any possibility that such an abnormality is overlooked by the user.

DETAILED DESCRIPTION OF THE PREFERRED EMBODIMENTS

Hereinafter, with reference to the accompanying drawings, the description will be made of the embodiments according to the present invention. (Description of an example of a cartridge provided with a non-volatile memory, which is applicable to the present invention)

Figure 1:
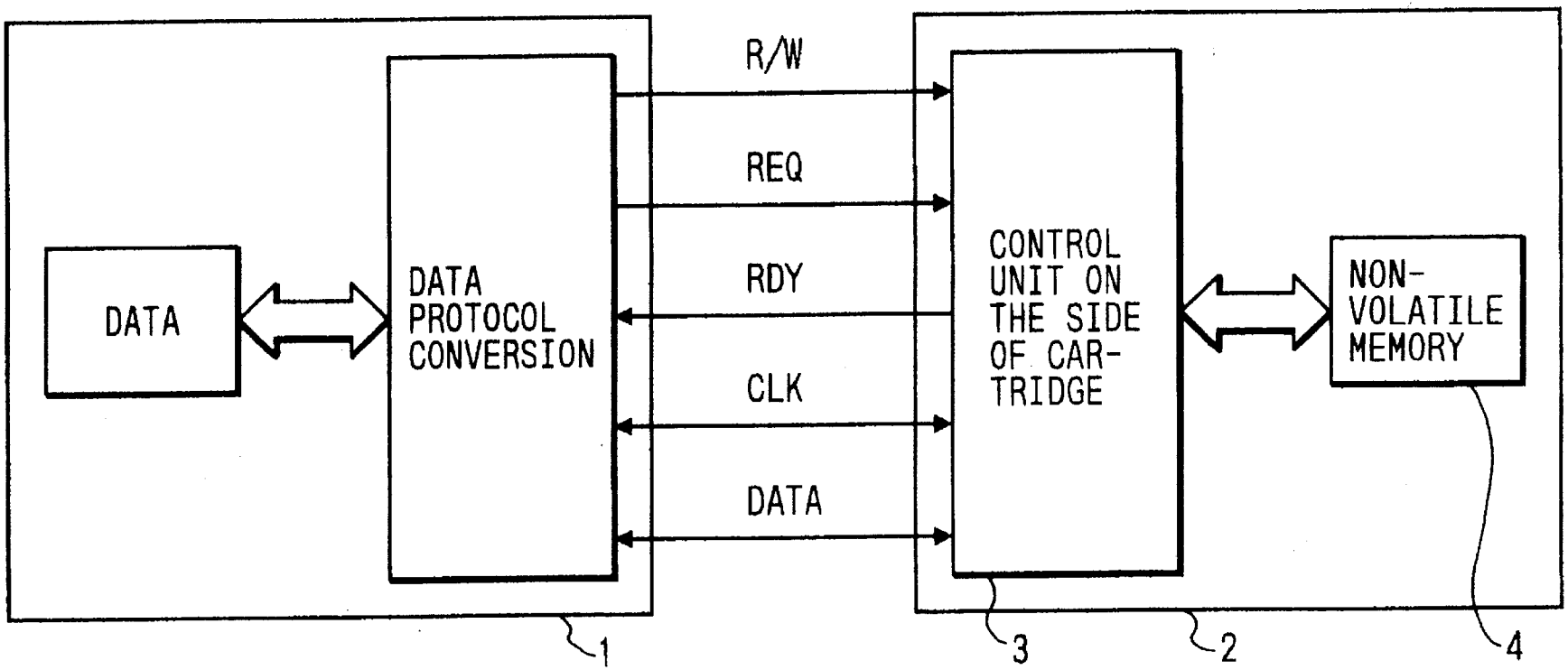
FIG. 1 is a block diagram schematically showing the principal part of a first embodiment of a recording apparatus according to the present invention.

FIG. 1 is a block diagram schematically showing the principal part of a recording apparatus. As shown in FIG. 1, a cartridge 2 serving as a colorant container comprises a container (not shown) containing a recording material such as ink or toner; a non-volatile memory 4; and a cartridge control unit 3 for controlling the write and read processes of information to and from the non-volatile memory 4. The cartridge 2 is detachably mounted in the main body of the recording apparatus. The non-volatile memory 4 is of a serial data input and output type, and its storage capacity is 128 bits. The cartridge control unit 3 and the control board 1 of the main body of the recording apparatus are connected with each other by each of the signal lines of R/W, REQ, DRY, CLK, and DATA when the cartridge 2 is mounted in the main body of the recording apparatus. As clear from this arrangement, the control means for reading out and writing in the required information is constituted by the control board 1 and the control unit 3 on the cartridge side. Also, a recording head (not shown) for enabling ink or toner to adhere to a recording medium may be provided for the main body of the recording apparatus or may be integrally formed with the cartridge 2. In either case, however, a structure is so arranged that the ink or toner in the container is supplied to the recording head through a connecting tube (not shown).

Figure 2B:
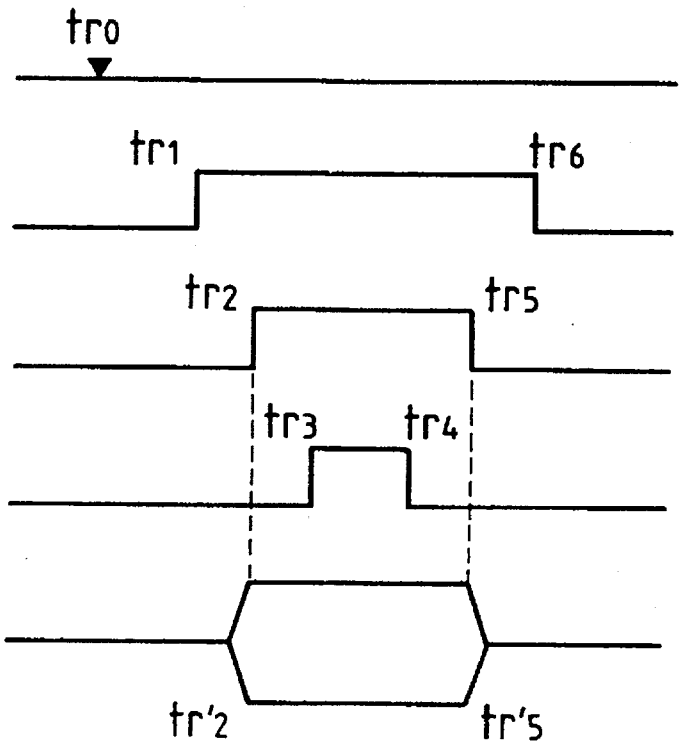
FIGS. 2A and 2B are timing charts showing the data read and write processes, respectively to be executed by the recording apparatus shown in FIG. 1.
Figure 2A:
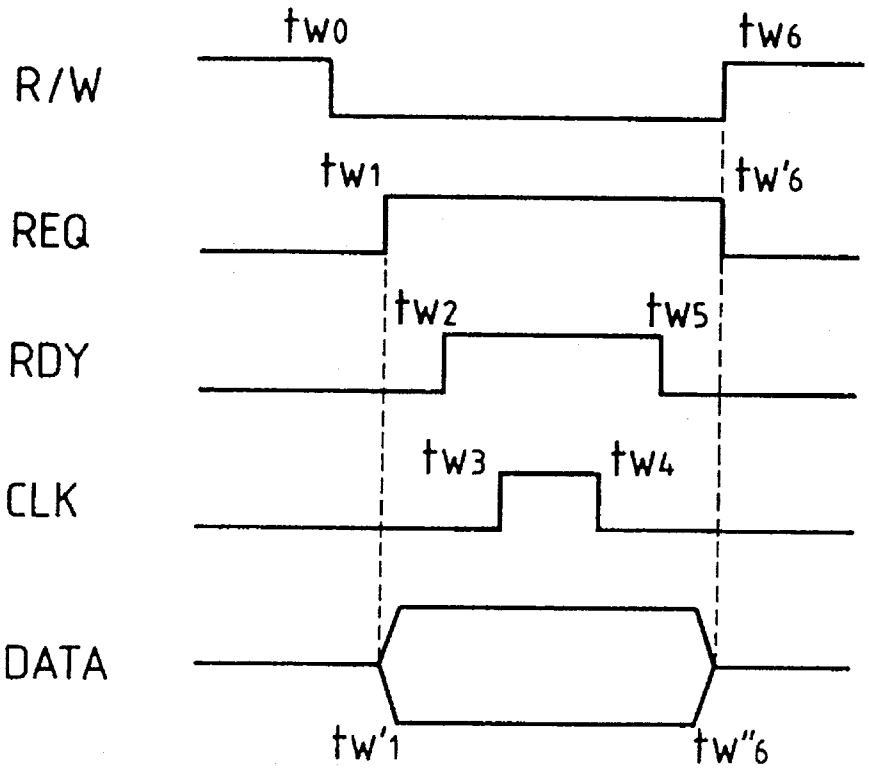

FIG. 2A is a write process timing chart, while FIG. 2B is a read process timing chart. In FIG. 2, it is illustrated that synchronism is taken as required by each of the above-mentioned signal lines, and the data are being transferred bit by bit. Also, the conditions of each timing shown in FIG. 2 are: in the write process, $t_{w0}<t_{w1}<t_{w2}<t_{w3}<t_{w4}<t_{w5}<t_{w6}$, $t_{w1}$~$t_{w1}$', and $t_{w6}$~$t_{w6}$ '~ $t_{w6}$"; also, in the read process, $t_{r0}<t_{r1}<t_{r2}<t_{r3}<t_{r4}<t_{r5}<t_{r6}$, $t_{r2}=t_{r2}$', and $t_{r5}=t_{r5}$'.

Figure 3:
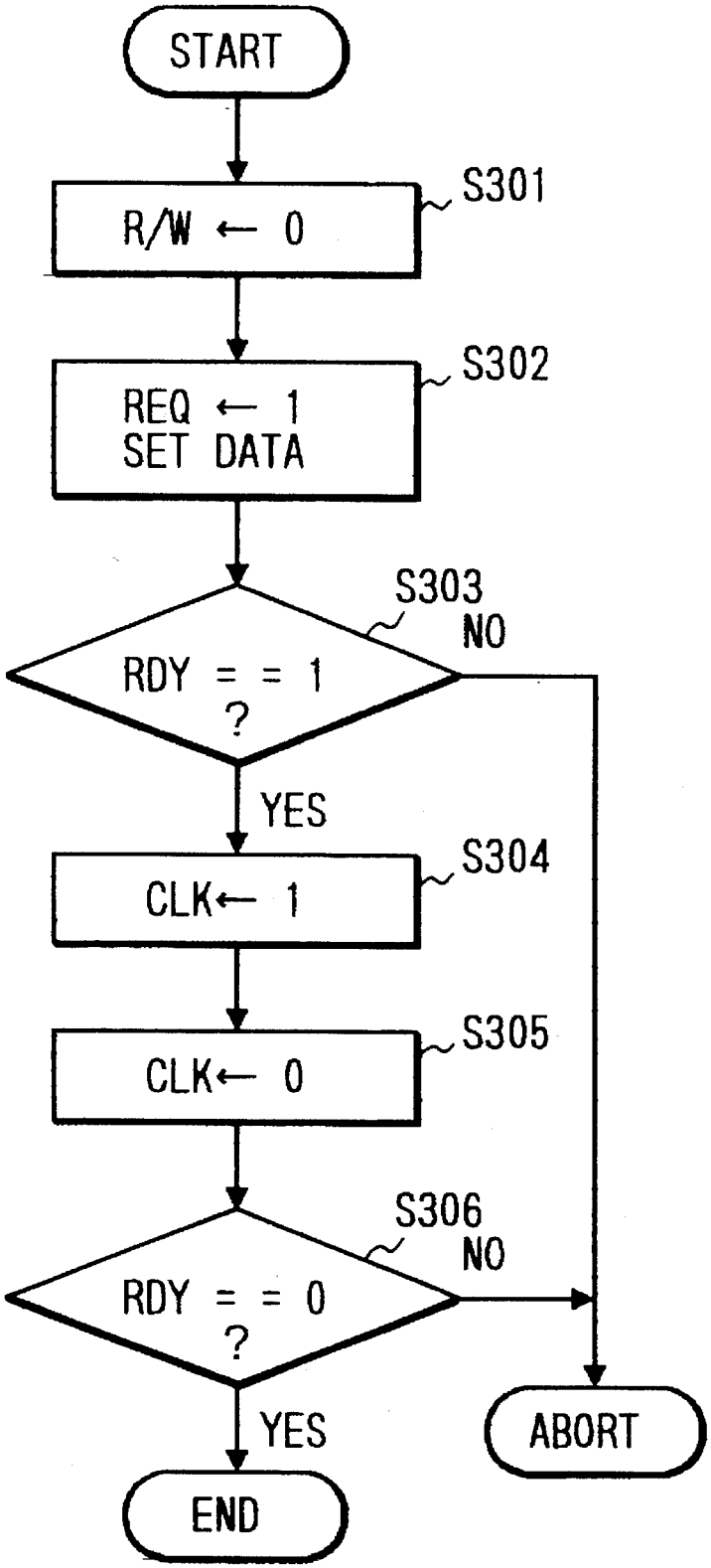
FIG. 3 is a flowchart showing the procedures of writing data to the cartridge shown in FIG. 1.

Now, with reference to FIG. 2 and FIG. 3, the description will be made of the procedures of writing data to the non-volatile memory 4 (refer to FIG. 1). Here, the wait time between each of the steps is omitted, but it is assumed that an appropriate time is set depending on the characteristic properties of the device to be used in order to assure its operation.

At first, the R/W is reset (S301). Then, data are written in the DATA line and the REQ is reset (S302). Now, whether the control circuit 3 on the cartridge side (refer to FIG. 1) returns the RDY or not is examined (S303). If no RDY is set at this time, the arrangement is regarded as fault. This is informed accordingly, and then, the process will terminate. If the RDY is set, the CLK is set (S304), and further, the CLK is reset (S305), thus enabling the data to be transferred. After the reception of this setting and resetting of the CLK, the control circuit on the cartridge side 3 resets the RDY. Then, the resetting of the RDY is confirmed (S306). If no RDY has been reset, the arrangement is regarded as fault. This is informed accordingly and the process will terminate. If the RDY is reset, the process will terminate normally, and an arbitrary information such as the product classification and product number of a cartridge 2, and the remains of ink or toner in the container of the cartridge 2, is written in the non-volatile memory 4 (refer to FIG. 1).

Figure 4:
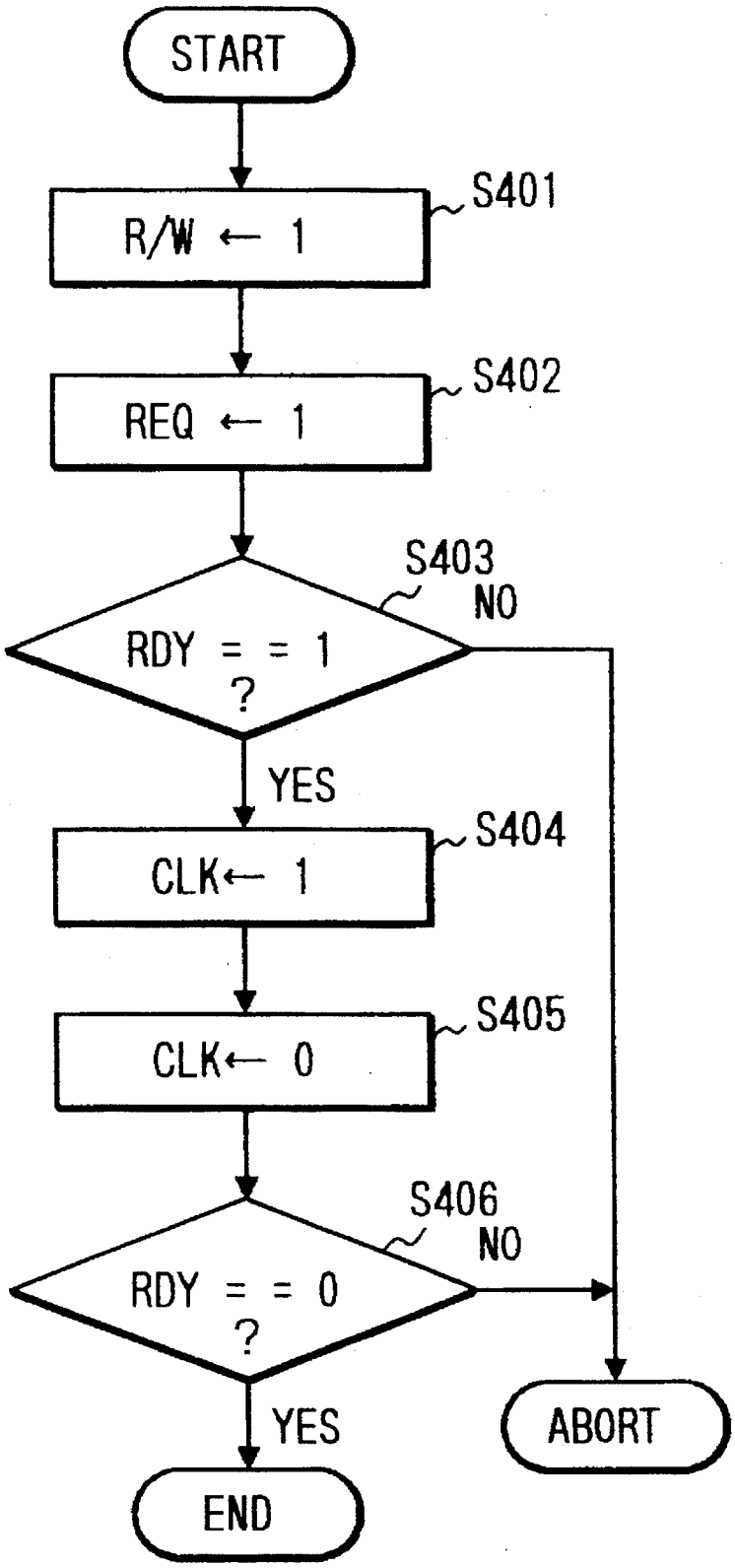
FIG. 4 is a flowchart showing the procedures of reading data from the cartridge shown in FIG. 1.

Now, with reference to FIG. 4, the description will be made of the procedures of reading data from the non-volatile memory. Here, as described in conjunction with FIG. 3, it is assumed that an appropriate wait time is set between each of the steps in order to assure the respective operations.

At first, the R/W is reset (S401). Then, the REQ is reset (S402). When the REQ is reset, the RDY will be returned by the control circuit on the cartridge side 3 (refer to FIG. 1). Therefore, whether the RDY is reset or not can be examined (S403). If no RDY is set at this juncture, the arrangement is regarded as fault. This is informed accordingly, and the process will terminate. If the RDY is set, the CLK is set (S404), and the CLK is reset (S405), thus reading the data written in the non-volatile memory 4 (refer to FIG. 1) transferring the data. Then, after having confirmed whether the RDY is reset or not (S406). If it is still set, the arrangement is regarded as fault. This is informed accordingly, and the process will terminate. If the RDY has been reset, the process will terminate normally.

As described above, with the provision of the nonvolatile memory 4 in the cartridge 2 as well as the control board 1 and control unit on the cartridge side 3 for executing the write and read processes of information to and from the non-volatile memory 4, it is possible to give the cartridge 2 the kind and characteristic properties of the cartridge 2, and some more information, and at the same time, to rewrite these pieces of information freely, thus enabling the general usability of the cartridge 2 to be enhanced. Here, it is also possible to know the remains of ink or toner in the cartridge 2 by storing the number of recorded dots in the non-volatile memory as required. Also, in order to distinguish one from the other it becomes unnecessary to change the contours of the cartridges 2 per kind. The contours of the cartridges 2 can be unified, thus making the provision of the cartridges 2 possible at a lower cost. Further, when the cartridges 2 are recycled after use, the information in a particular cartridge 2 can be rewritten freely. This will contribute to making the reuse of the cartridges 2 easier. (Description of an example of the ink remain detecting system which is applicable to the present invention)

Figure 5:
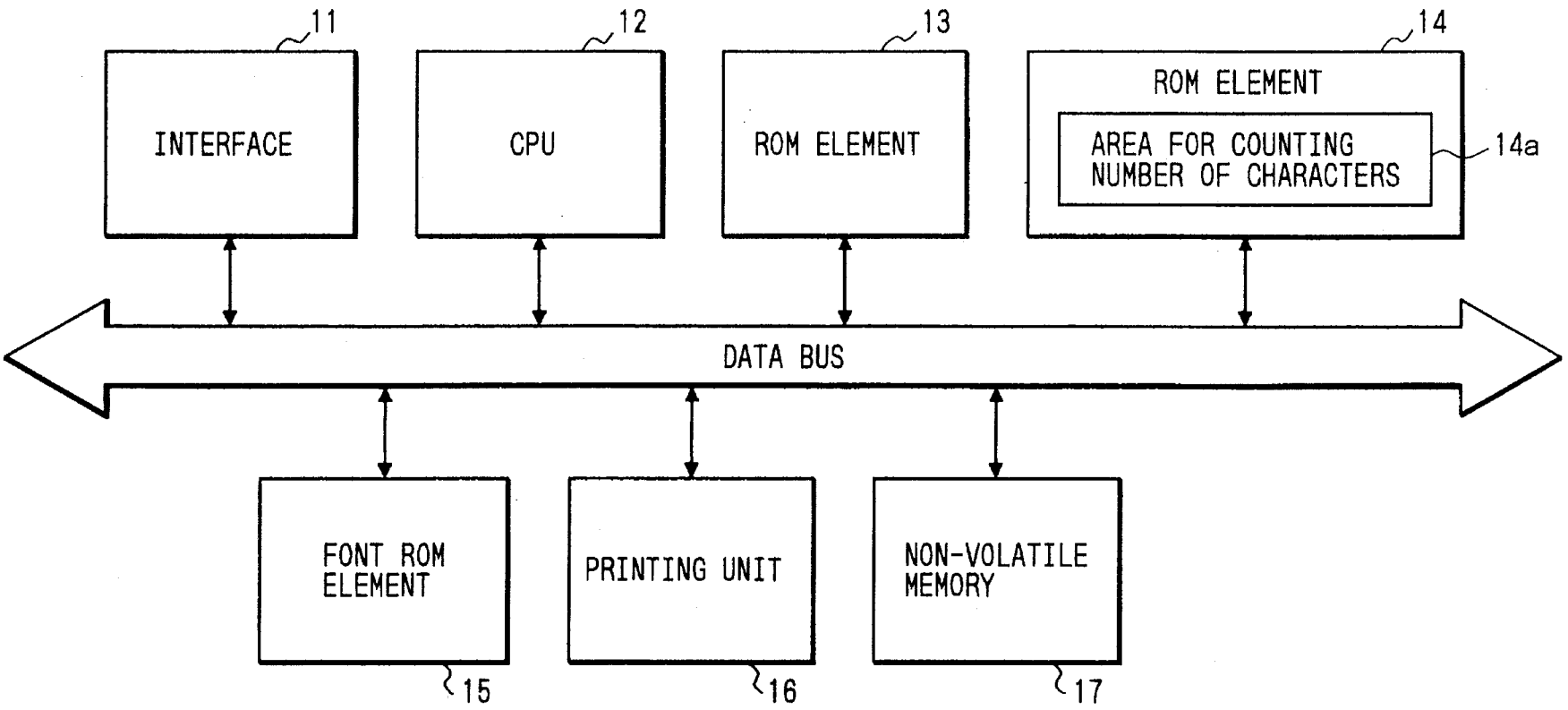
FIG. 5 is a block diagram schematically showing a second embodiment of the recording apparatus according to the present invention.

FIG. 5 is a block diagram schematically showing a recording apparatus. This recording apparatus is the one which mainly prints characters such as a list printer. To the data bus of this recording apparatus, there are connected an interface 11 to receive data to be printed; a CPU 12 to control the entire systems of the recording apparatus; a ROM element 13 to store the program necessary for the CPU 12 to execute its processing; a RAM element 14 to provide the operational storage area needed by the CPU 12; a font ROM element 15 to store character fonts; a printing unit 16 provided with a recording head (not shown) for printing characters on a recording medium; and a non-volatile memory 17 to store the number of the printed characters and others, respectively.

In the RAM element 14, a character number counting area **14*a* is set aside as a temporary working area for counting the number of the printed characters. The number of the printed characters which is counted in the character number counting area 14*a* is stored in the non-volatile memory 17 each time the characters have been printed. Also, the non-volatile memory 17 is arranged to clear its stored information when the cartridge (not shown) is mounted in the main body of the recording apparatus. The cartridge serves as a colorant container as is detachable mountable in the apparatus. In other words, the non-volatile memory 17 stores the number of the printed characters accumulatively since the time the cartridge is mounted in the main body of the recording apparatus. The number of recorded characters is thus calculated by use of the RAM element 14 and non-volatile memory 17**, which constitute calculating means together for providing the information of colorant remains in the colorant container.

Here, given the amount of ink contained in the cartridge as a colorant before starting to use the cartridge as FV [$cm^3$], and also, the value of the average ink consumption per character, which is statistically obtained, as CV [$cm^3$/character], the number of printed characters n which will consume the ink in the cartridge completely is obtainable by an expression of n=FV/CV [characters] because the number of printed characters n is proportional to the ink consumption. The value n thus obtained is arranged as a value N by discarding the figures below the decimal point, and is defined as a predetermined value N at which to issue an ink shortage warning.

Figure 6:
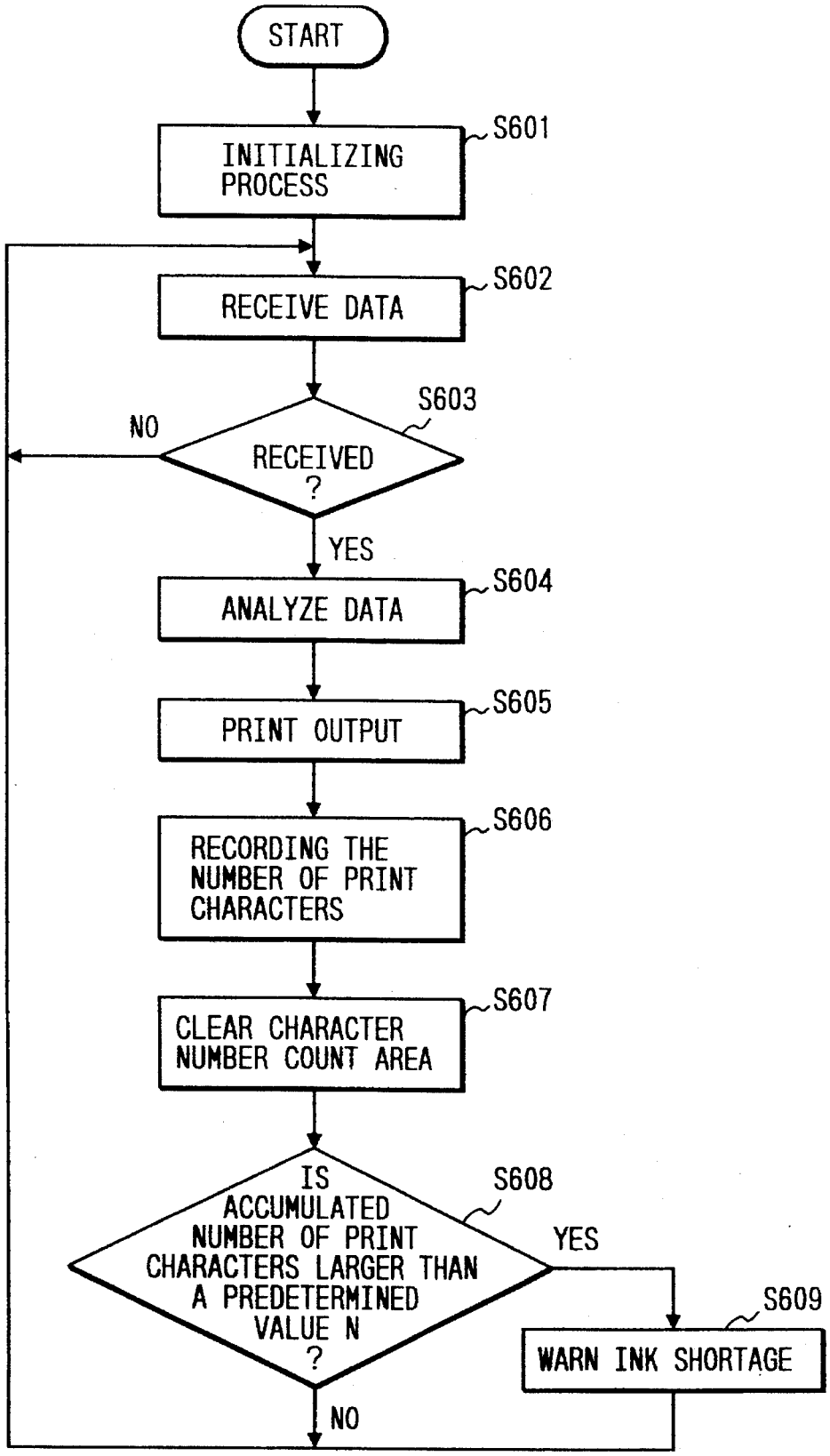
FIG. 6 is a flowchart showing the outline of the entire operation of the recording apparatus shown in FIG. 5.

Now, with reference to a flowchart shown in FIG. 6, the operation of this recording apparatus will be described. At first, when the recording apparatus is turned on, the initializing process for the recording apparatus itself is executed (S601). At this juncture, the character number counting area **4*a* is cleared to make its value zero. Then, the apparatus will be on standby until a print character data is received (S602 and S603). When the print character data is received, the received data is analyzed (S604). The data thus analyzed is transferred to a printing unit 16 for printing (S605). Then, each time a character is printed, the value of the character number counting area 14*a* is incremented. When data are all printed, the value stored in the non-volatile memory 17 is read. In the non-volatile memory 17, the number of characters printed by this cartridge up to the last printing is stored. When this cartridge is used for the first-time printing, there is no stored value in the non-volatile memory 17. The value is zero. To the stored value, the value of the character number counting area 14*a*, and the added value is again stored in the non-volatile memory 17, thus counting the number of the printed characters accumulatively (S606). Then, the character number counting area 14*a* is cleared (S607) to set its value at zero. The accumulated print character numbers obtained in the step S606 and the foregoing predetermined N value are compared (S608) to determine whether the ink is in short supply or not. In other words, if the accumulated print character numbers exceed the predetermined value N, it is interpreted that the ink is in short supply. Thus, after an ink shortage warning is given (S609**), the apparatus will be again on standby, waiting for a data to be processed. If the accumulated print character numbers are still lower than the predetermined value N, it is interpreted that the ink is still available. The apparatus will be again on standby as it is, waiting for a data to be processed.

As described above, according to the present embodiment, the information on ink remains in the cartridge is obtained by counting the number of the printed characters without using any level sensor or the like. Therefore, it is possible to detect the ink remains in a precision constantly maintained. Also, there is no need for a level sensor or the like to be installed in the cartridge, hence resulting in the implementation of the cartridge fabrication at a lower cost, and at the same time, contributing to the resource saving because when a cartridge is discarded, what is disposed of is only the cartridge, and not together with any level sensor or the like. (Description of another example of the ink remain detection system which is applicable to the present invention)

Figure 7:
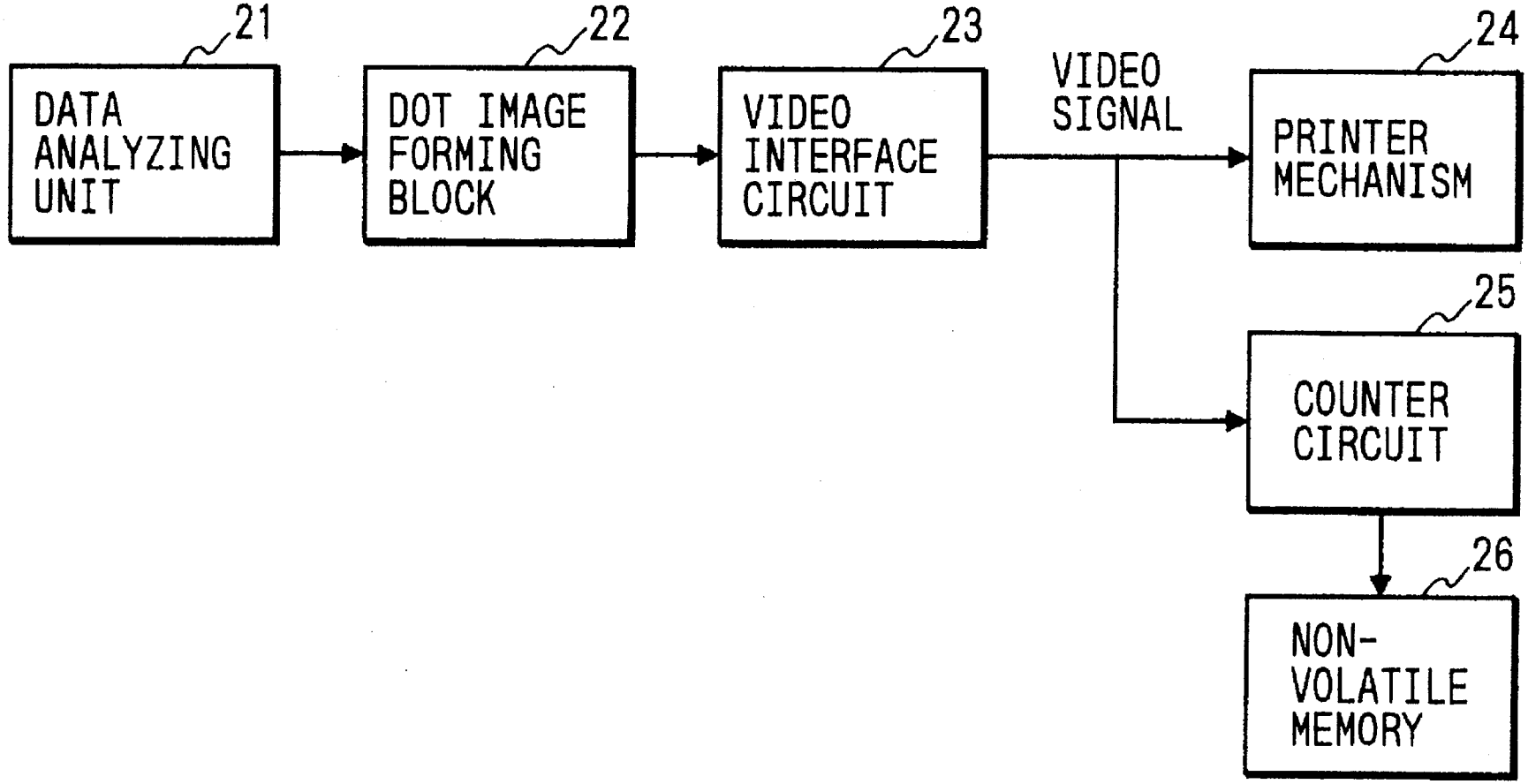
FIG. 7 is a block diagram schematically shown a third embodiment of the recording apparatus according to the present invention.

FIG. 7 is a block diagram schematically showing a recording apparatus. This recording apparatus is a laser beam printer of a line scanning type. As shown in FIG. 7, the apparatus comprises a data analyzing unit 21 to analyze the received data; a dot image formation block 22 which executes the image development of the data analyzed by the data analyzing unit 21; a video interface circuit 23 which receives the image data developed by the dot image formation block 22 and generates the video signals; a printer mechanism 24 provided with a recording head (not shown) which records on a recording medium in accordance with the video signals generated by the video interface circuit 23; a counter circuit 25 which counts the pulse signals of the video signals generated by the video interface circuit 23; and a non-volatile memory 26 which adds the values output from the counter circuit 25 and stores them in it. Here, the non-volatile memory 26 is so arranged that whenever a cartridge (not shown) which is detachably mountable in the recording apparatus as a colorant container is mounted in the recording apparatus, the stored contents of the memory are cleared. In other words, the number of recorded dots is accumulatively stored in the non-volatile memory 26 since when the cartridge is mounted in the main body of the recording apparatus. The recorded dot numbers are counted by the counter circuit 25 and the non-volatile memory 26, which constitute a counting means to provide the information of colorant remains in the colorant container in accordance with the resultant value of such counting and storage. Also, the ink consumption required for printing one dot is obtained by a measurement and others in advance. Here, the total number of dots which consumes the ink completely is defined as a predetermined value CV.

Figure 8:
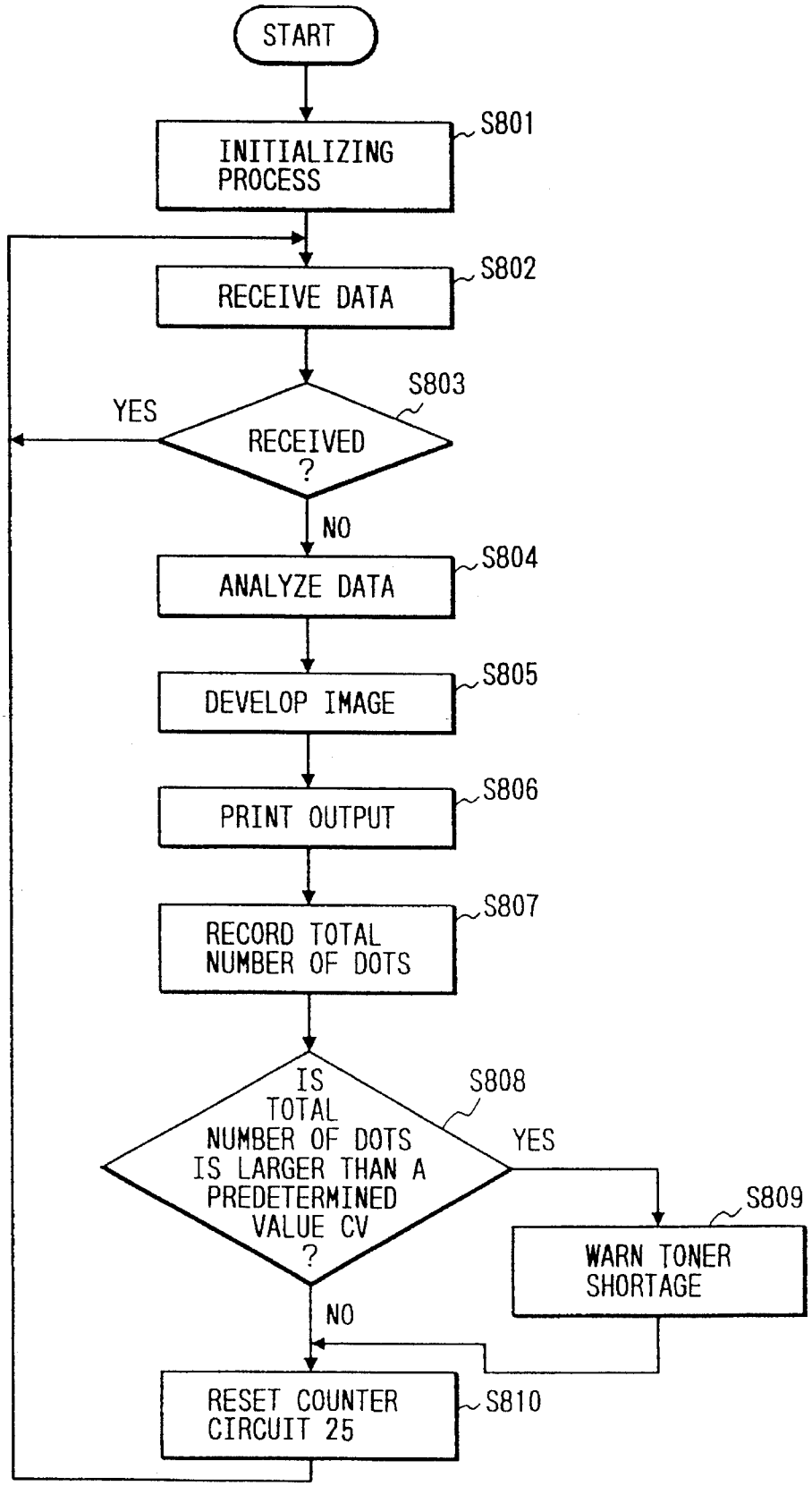
FIG. 8 is a flowchart showing the outline of the entire operation of the recording apparatus shown in FIG. 7.

Now, with reference to a flowchart shown in FIG. 8, the operation of the present recording apparatus will be described. At first, when the apparatus is turned on, the initializing process for the apparatus itself is executed (S801). At this juncture, the counter circuit 25 is reset to make its value zero. Then, the apparatus will be on standby until a print character data is received (S802 and S803). When the print character data is received, the data analyzing unit 21 analyzes the data thus received (S804). The analyzed data is developed into an image data by the dot image formation block 22 (S805), and further, this image data is transferred to the printer mechanism 24 for printing (S806). At this time, the counter circuit 25 counts the pulse signals from the video interface circuit 23 to record the dot numbers of the printing data. When the printing is completed, the non-volatile memory 26 adds the dot numbers which have been counted by the counter circuit 25 to obtain the total dot numbers in this particular cartridge. Here, if any printing is executed by use of the same cartridge preceding the current printing, the total number of dots up to the last printing has been stored in the non-volatile memory 26. Therefore, the total number of dots in the same cartridge is obtained by adding the current dot numbers being counted by the counter circuit 25 per print output to such an already stored value to update the storage. In this way, the foregoing predetermined value CV and the total number of dots obtained in the step S807 are compared (S808) in order to determine whether the ink supply is in short or not. In other words, if the total number of dots exceeds the predetermined value CV, it is interpreted that the ink is in short supply, and then, after giving an ink shortage warning (S809), the value of the counter circuit 25 is reset to make it zero (S810). The apparatus will be again on standby, waiting for a data to be processed. If the total number of dots is lower than the predetermined value CV, it is interpreted that the ink is still available. The counter circuit 25 is just reset (S810), and the apparatus will be again on standby, waiting for a data to be processed.

In this example, too, it is possible to obtain the same effects as in the foregoing example by counting the total number of dots to obtain the ink remain information in the cartridge.

(First Embodiment)

Figure 9:
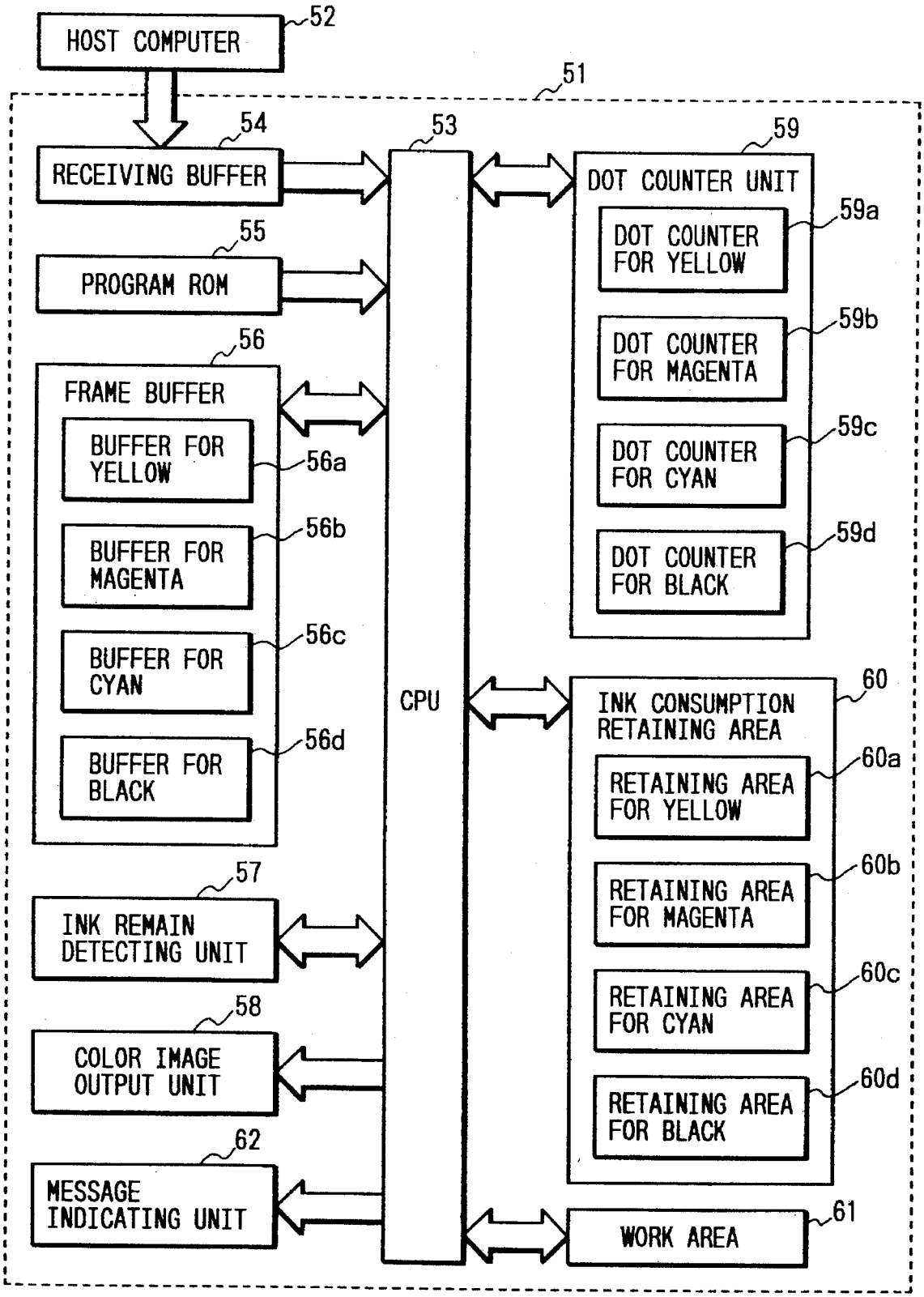
FIG. 9 is a block diagram schematically showing a fourth embodiment of the recording apparatus according to the present invention.
Figure 10:
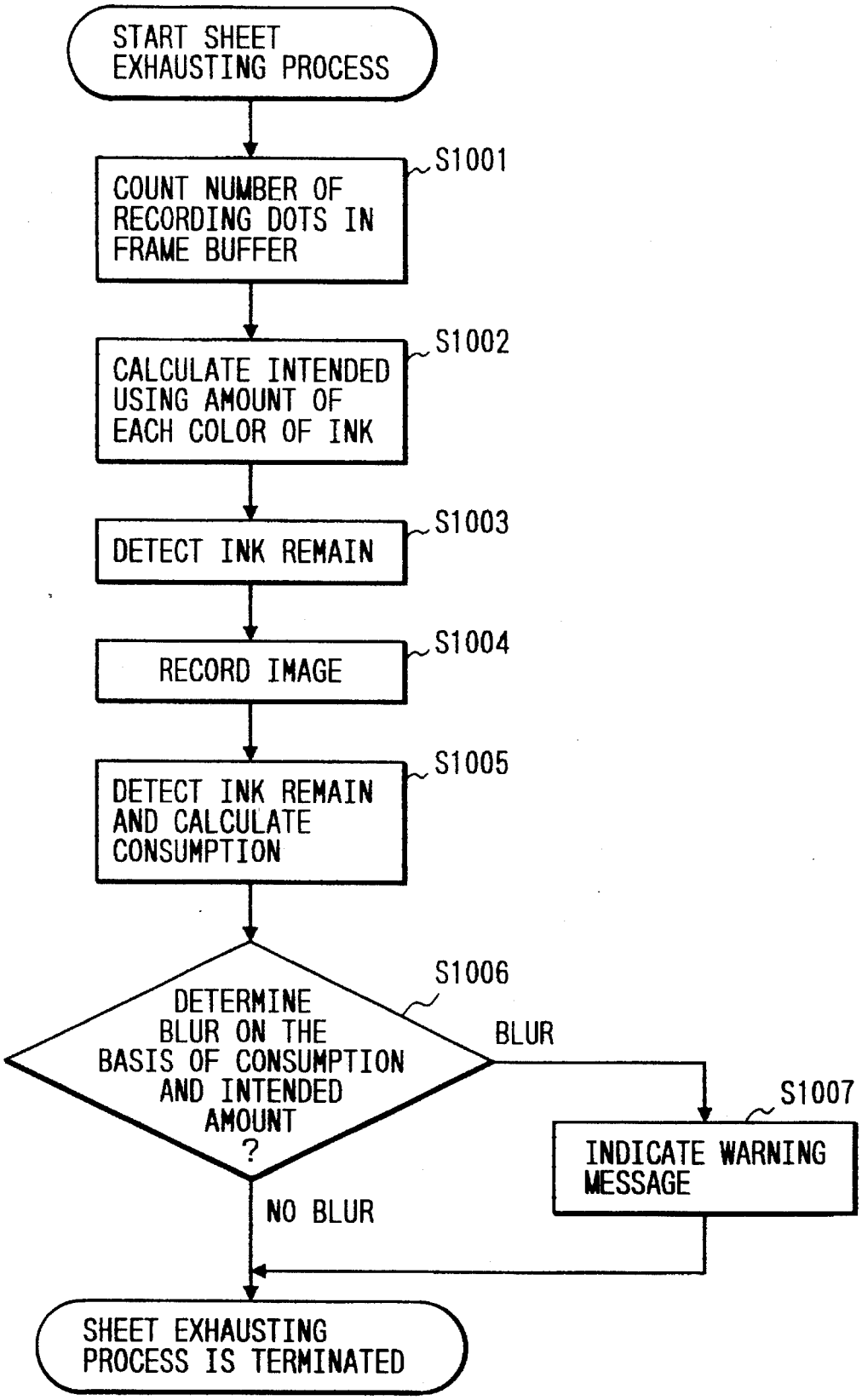
FIG. 10 is a flowchart showing the procedures of a sheet exhausting process in the recording apparatus shown in FIG. 9.

FIG. 9 is a block diagram schematically showing a first embodiment of the recording apparatus according to the present invention. The recording apparatus according to the present embodiment is a color image recording apparatus which records a color image by use of four kinds of color ink, yellow, magenta, cyan, and black. In the main body of the color image recording apparatus 51, a CPU 53 is provided, which controls the entire systems of the color image recording apparatus in accordance with a program stored in a program ROM 55 to be described later. A receiving buffer 54 stores temporarily color image data transmitted from a host computer 52 and then, transfer them to the CPU 53. The program ROM 55 serving as a determining means enables the CPU 53 to control the color image recording apparatus, and stores a program having the algorithm which is shown in FIG. 10. A frame buffer 56 is a memory holding the binary-coded image patterns created per ink color, and comprises buffers **56*a*, 56*b*, 56*c*, and 56*d* respectively for each ink color. A color image output unit 58 having recording heads (not shown) is provided with a plurality of discharging ports (not shown) respectively for each ink color. This unit executes the recording on a recording medium by discharging ink from the foregoing discharging ports in accordance with the image pattern per ink color held in each frame buffer 56. An ink remain detecting unit 57 serving as ink amount detecting means is provided in each of the four ink containers (not shown) for each ink color, and detects the ink remains for each ink color for the transmission of the detected value to the CPU 53. The ink in each of the ink containers is supplied to each of the discharging ports in the color image output unit 58 corresponding to each ink color through the respective ink supply passages (not shown). A dot counter unit 59 serving as calculating means is a memory to hold a counted value of dot numbers to be recorded among the binary-coded image patterns per color held by the frame buffer 56, which are created by processing the color image data being transmitted from the host computer 52, and comprises four dot counters 59***a*, 59*b*, 59*c*, and 59*d* for each of the four kinds of color. An ink consuming amount holding area 60 is the area where an ink amount used for recording a sheet of recording medium is calculated and held, and as in the dot counter unit 59, four ink consuming amount holding areas 60*a*, 60*b*, 60*c*, and 60*d* are arranged for each of the four kinds of color. In this respect, the ink consuming amount holding area 60 may be arranged integrally with the ink container as in the case of the non-volatile memory 4 provided in the cartridge shown in FIG. 1. A work area 61 is a memory to be used as a work area. By using this memory, the binary-coded image patterns are created from the image data, and the expected amount of ink to be used is calculated among the execution of various other processes. A message indicating unit 62 serving as notifying means displays such an indication as to the presence of an abnormality in the color image recording apparatus among other information.

Now, with reference to FIG. 10, the description will be made of the image recording operation and the recording medium exhausting operation of the present embodiment. FIG. 10 is a flowchart showing the procedures of executing a medium exhausting operation of the recording apparatus shown in FIG. 9. The procedures are a part of the program stored in the program ROM 55, which deals with the process in response to a command on the medium exhausting operation. In this respect, the color image recording apparatus according to the present embodiment is the one which receives color image data from a host computer 52 and interprets various commands contained in them in order to execute the creatation of the binary-coded image patterns in color, but those known processes are just good enough for creating the binary-coded image patterns and the like, which are not directly concerned with the present invention. Here, therefore, the description thereof will be omitted.

The processes shown in FIG. 10 begin when the apparatus recognizes the command on the medium exhausting operation among the color image data received from the host computer 52. At first, the dot numbers to be recorded are counted per binary-coded pattern of each color in the frame buffer 56. Each of the counted values is set in the dot counters 59*a*, 59*b*, 59*c*, and 59*d* corresponding to each color in the dot counter unit 59 (S1001). Then, from the counted dot numbers, the expected amount of ink to be used for the required recording of the image in the frame buffers 56 is calculated for each color, and held in the work area 61 (S1002). Here, the expected amount of ink to be used is represented by a value arrived at by multiplying the ink consumption per dot by the recording dot numbers. The ink consumption per dot is stored in the program ROM 55 in advance. Then, the ink remains before the image recording is detected per color by the ink remain detecting unit 57. The ink remains per color is stored in each of the holding areas 60*a*, 60*b*, 60*c*, and 60*d* corresponding to each color in the ink consuming amount holding area 60 (S1003). Then, in accordance with the binary-coded image patterns in each color held in the frame buffer 56, the image is being recorded on a recording medium by the color image output unit 58, and the recording medium is exhausted (S1004).

When all the image patterns in the frame buffer 56 are recorded, the ink remains for each color are again read from the ink remain detecting unit 57, and then, the values stored in each of the holding areas 60*a*, 60*b*, 60*c*, and 60*d* in the ink consuming amount holding area 60 are subtracted by the values of the ink remains thus read (S1005). In this way, the respective amount of ink actually consumed for each color by recording the image is held in the ink consuming amount holding area 60. Then, on the basis of the amount of ink actually consumed and the expected amount of ink to be used which is held in the work area 61, it is determined whether the recorded image is blurred or not due to the clogging of the discharging ports or the like (S1006). In other words, it is assumed that the ink has been discharged as expected if a relationship between the ink actually consumed and the expected amount of ink to be used satisfies the relationship which can be expressed by a formula of (the ink actually consumed)≧ (the expected amount of ink to be used)−(an allowable value of consumption), and thus, the image is also regarded as correctly recorded. Here, the allowable amount of consumption in the above formula is a corrected value arrived at after having considered the detection errors of the ink remain detecting unit 57, the variation of ink discharging amount per dot, and the like. This value is stored in the program ROM 55 in advance. On the other hand, if the relationship does not satisfy the above formula, it is assumed that the ink has not been discharged normally, thus regarding the recorded image as having blurs, defective color tones, or other defective.

If it is determined that there is no abnormality and the recording has been executed correctly based on the above formula, the medium exhausting operation will terminate as it is. On the other hand, if it is determined that there is an abnormality, a warning message is displayed on the message indicating unit 62 accordingly (S1007), and then, the medium exhausting operation will terminate.

As described above, in recording the image on a one-page, the recording apparatus itself determines whether there is any abnormality due to the clogging of the discharging ports, the insufficient supply of ink to the discharging ports, or the like on the basis of the amount of ink actually consumed. If any abnormality is found, the apparatus warns the use about it promptly, hence making it possible for the user to detect any defectives in the recorded image without depending on his visual examination. Also, when the output tonality is different from the specified one, it is due to the abnormal ink discharge if a warning message is displayed in the message indicating unit 62. If no warning message is displayed, it should be due to the wrong color designation. Therefore, this can be corrected immediately to record an image in the correct tonality.

In the present embodiment, the description has been made of an example in which the ink used for recording a color image is in four colors, yellow, magenta, cyan, and black, respectively, but the colors are not necessarily limited to these four. It may be possible to use only three colors, yellow, magenta, and cyan, or use other kinds of color ink. The present invention is not limited to the ink color made available by a color image recording apparatus. Also, in the present embodiment, it is assumed that one pixel (one bit) of the binary-coded image pattern in the frame buffer 56 corresponds to one dot of the image to be actually recorded, but the present invention is not limited to the number of dots of the recorded image each corresponding to one pixel of the binary-coded image pattern in the frame buffer 56. The present invention may be applicable to the binary-coded image pattern the one pixel of which corresponds to a plurality of dots of the recorded image.

According to the present embodiment, it is possible for the recording apparatus itself to automatically judge the foregoing defectives without the user's visual confirmation.

Therefore, it is possible to find such defectives reliably, which the user may otherwise overlook in examining them visually.

(Second Embodiment)

Figure 11:
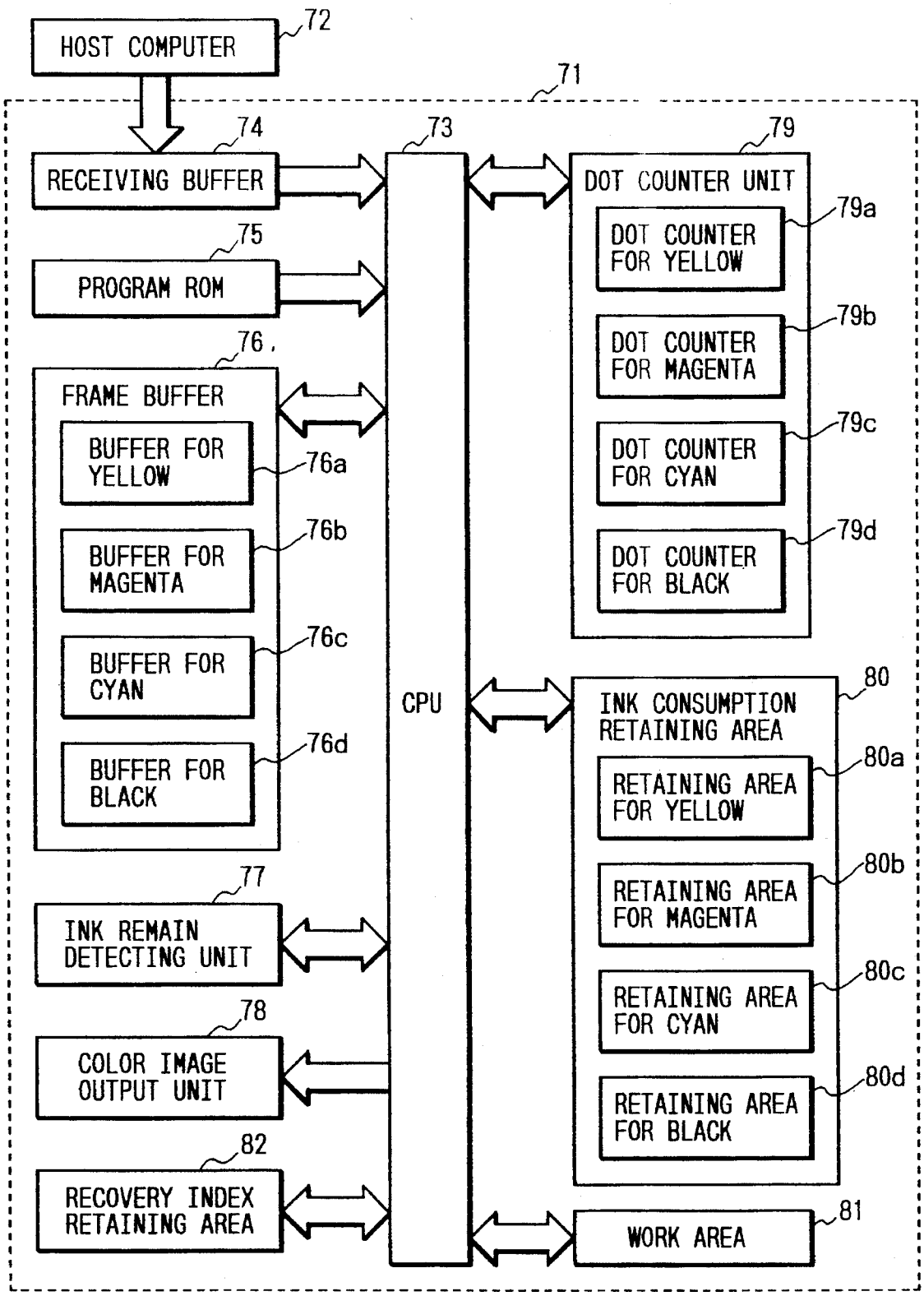
FIG. 11 is a flowchart schematically showing a fifth embodiment of the recording apparatus according to the present invention.

FIG. 11 is a block diagram schematically showing a second embodiment of the recording apparatus according to the present invention. The recording apparatus according to the present embodiment also receives image data from a host computer 72 as in the first embodiment, and creates a binary-coded image pattern for each of the four colors, yellow, magenta, cyan, and black. The apparatus records on a recording medium by superposing these four-color image patterns on it. CPU 73, receiving buffer 74, frame buffer 76, ink remain detecting unit 77, color image output unit 78, dot counting unit 79, ink consuming amount holding area 80, and work area 81 are the same as those in the first embodiment. Therefore, the description thereof will be omitted.

In the present embodiment, what differs from the first embodiment are the contents of the program stored in the program ROM 75, a recovery index holding area 82, and a recovery unit (not shown) serving as recovery means. The program stored in the program ROM 75 has an algorithm shown in FIG. 12, the details of which will be described later. The recovery index holding area 82 is to hold the recovery index which will be used for determining whether any improvement of the quality of recorded image can be expected or not by allowing the recovery unit to execute the recovery process once more. Also, the foregoing recovery unit is to execute a head recovery process such as removing the excessively viscous ink in the discharging ports by causing the ink to be exhausted forcibly from the discharging ports among some others by use of an appropriate sucking means to suck the ink or an appropriate pressuring means arranged on the ink supply passage to the ink jet recording head to pressurize the ink to flow when the discharging ports of the foregoing color image output unit 78 are clogged.

Figure 12:
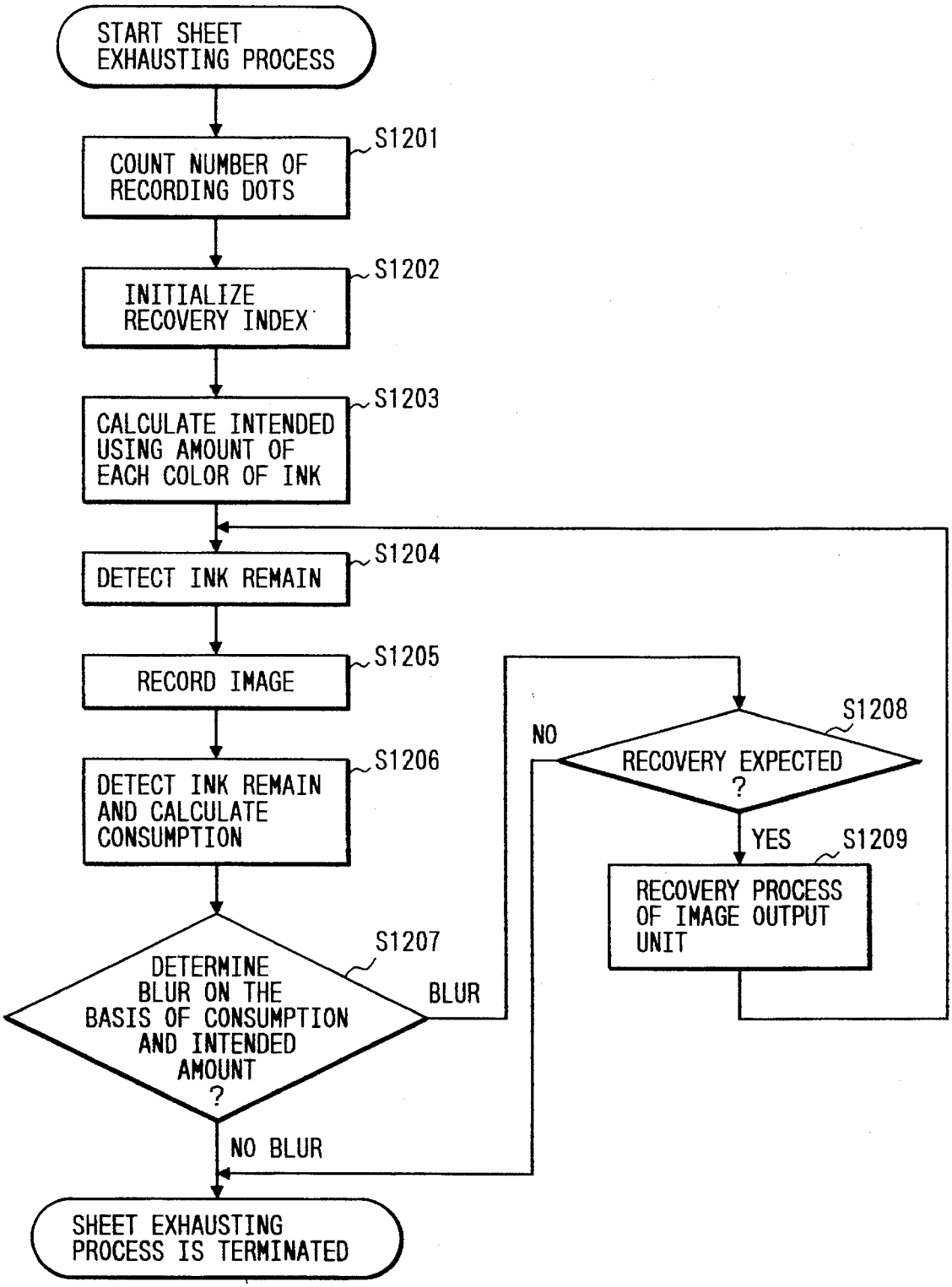
FIG. 12 is a flowchart showing the procedures of a sheet exhausting process in the recording apparatus shown in FIG. 11.

Now, with reference to FIG. 12, the description will be made of the image recording operation and the recording medium exhausting operation according to the present embodiment. FIG. 12 is a flowchart showing the procedures of executing a medium exhausting operation for the recording aparatus shown in FIG. 11, which represents the part of the program stored in the program ROM 75 dealing with the processes in response to the command related to the medium exhausting operation.

The processes shown in FIG. 12 begin when recognizing the command on the medium exhausting operation among the color image data transmitted from the host computer 72. At first, the number of dots to be recorded is counted per binary-coded pattern of each color in the frame buffer 76. The respective values thus counted are stored in the dot counters 79*a*, 79*b*, 79*c*, and 79*d* of the dot counter unit 79 corresponding to each color (S1201). Then, the value of the recovery index in the recovery index holding area 82 is initialized (S1202). For the initial value at this juncture, it is arranged to adopt the value of a required amount of ink each for recording an image to be recorded on the surface of a full page by superposing four colors for such recording. Then, from the counted dot numbers, the expected amount of ink to be used for recording the image in the frame buffer 76 is calculated per color, and held in the work area 81 (S1203). Here, the expected amount of ink to be used is represented by a value arrived at by multiplying the ink consumption per dot by the number of the dots to be recorded. The ink consumption per dot is held in the program ROM 75 in advance. Then, the ink remains before recording the image is detected per color by the ink remain detecting unit 77. The ink remains per color is stored in the holding areas 80*a*, 80*b*, 80*c*, and 80*d* of the ink consuming amount holding area 80 corresponding to each color, respectively (S1204). Then, while the image is being recorded on the recording medium by the color image output unit 78 in accordance with the binary-coded image pattern of each color held in the frame buffer 76, the recording medium is exhausted (S1205).

When all the image patterns in the frame buffer 76 are recorded, the ink remains per color is again read from the ink remain detecting unit 77, and then, the value stored in each of the holding areas 80*a*, 80*b*, 80*c*, and 80*d* in the ink consuming amount holding area 80 is subtracted by the value of the ink remains thus read, respectively (S1206). In this way, in the ink consuming amount holding area 80, the amount of ink which has actually been consumed in recording the image is held per color. Then, on the basis of the amount of ink actually consumed and the expected amount of ink to be used, which is held in the work area 81, it is determined in the same way as the first embodiment whether there is any abnormality such as the blur of the recorded image or not due to the clogging of the discharging ports or the like (S1207).

Here, if it is determined that there are no defectives in the recorded image, the medium exhausting operation will terminate as it is. If any defectives are found, whether there is a possibility of recovery or not is determined (S1208). In this respect, the value currently held in the recovery index holding area 82 is compared with an aggregate of the difference between the expected amounts of ink to be used, which are previously calculated per color, and each amount actually consumed. In other words, given the value arrived at by subtracting the expected amounts of ink to be used per color by each amount actually consumed as $E_Y$, $E_M$, $E_C$, and $E_K$, it is determined whether a conditional expression of (the value of the recovery index holding area)$>E_Y+E_M+E_C+E_K+E_X$ is satisfied or not. The $E_X$ in this conditional expression is a constant held in the program ROM 75 in advance, which is a correction value prepared in consideration of the detection errors unavoidably committed by the ink remain detecting unit 77 and the variation of ink discharging amount per dot.

If the above conditional expression is not satisfied, it is determined that there is no possibility of recovery even if a recovery process is executed. Thus, the medium exhausting operation will terminate as it is. On the other hand, if the above conditional expression is satisfied, it is determined that there is a possibility of recovery. Then, after the value of the recovery index holding area is rewritten by the value of $(E_Y+E_M+E_C+E_K)$ the recovery process is executed for the color image output unit 78 (S1209). Subsequent to the recovery process executed for the color image output unit 78, the ink remains per color are again detected by the ink remain detecting unit 77 (S1204), thus starting the image recording over again.

For the determination of whether there is a possibility of recovery or not as described above, a comparison with the initial value held in the recovery index holding area 82 is used for the first-time determination. Nevertheless, since this initial value is extremely large as described earlier, the above-mentioned conditional expression is satisfied under any circumstances. Therefore, if it is determined that there is an image blur or the like on the basis of the difference between the expected amount of ink to be used and the amount actually consumed when the first-time image recording has been executed, the recovery process will be invariably executed once so that the image recording can be started over again. For the determination thereafter, that is, the second time and on, the value of the recovery index holding area 82 will be an aggregate of the four-color difference between the ink consumption before the execution of the last recovery process and the amount actually consumed. Therefore, it becomes possible to judge the effect of the last recovery process in accordance with the above-mentioned conditional expression. In other words, to determine whether there is a possibility of recovery or not by the application of the above-mentioned conditional expression means to judge whether the last recovery process has produced any effect or not. Therefore, if it is found effective, the recovery process will be again executed to implement the recovery of the color image output unit 78. This means in turn that any unnecessary recovery will be executed if the last recovery process is found ineffective.

As described above, in recording the image on a one-page, the image blur or other defectives are detected on the basis of the ink consumption, and at the same time, if any defectives are detected, the recovery process is automatically executed as far as it is effective, and the image recording will be started over again. It becomes unnecessary for the user to operate the recovery unit himself each time the recovery is needed. Also, since the effectiveness of a recovery process is confirmed whenever it is executed, it is possible to avoid any wasteful consumption of recording material and ink because the next recovery process and recording will not be executed unless the last recovery process is found effective.

Also, as in the first embodiment, the ink colors are not necessarily limited in the present invention. Also, it may be possible to arrange that the one pixel of a binary-coded image pattern corresponds to a plurality of dots of the recorded image.

In addition to the same effects obtainable by the first embodiment, it is possible according to the present embodiment to execute the recovery process by use of the recovery means as far as there is a possibility of recovery of the recording heads when an abnormality is detected in the recorded image due to the clogging of the discharging ports or the insufficient ink supply to the discharging ports, and to repeat the image recording over again, so that the recovery process is automatically executed whenever needed until the recording heads are recovered without any manual recovery operation by the user, hence obtaining a correctly recorded image ultimately. Also, according to the present embodiment, the effectiveness of the recovery process is judged by determining means so that the next recovery process and recording will not be executed if the last recovery process is found ineffective. As a result, there is no possibility that the recording material and ink are consumed wastefully.

The present invention produces an excellent effect on a recording apparatus using an ink let recording method, particularly the one in which the flying droplets are formed by utilizing thermal energy for recording.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quick response.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned the specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention.

In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an opening for absorbing pressure wave of the thermal energy is formed corresponding to the discharging ports.

Moreover, as the recording head for which the present invention is effectively utilized, there is a recording head of a full-line type having a length corresponding to the maximum width of a recording medium recordable by a recording apparatus. This full-line head may be the one structured by combining a plurality of the recording heads disclosed in the above-mentioned specifications or a single full-line recording head which is integrally formed.

In addition, the present invention is effectively applicable to a replaceable chip type recording head which is electrically connected with the main apparatus and for which the ink is supplied when it is mounted in the main assemble; or to a cartridge type recording head having an ink tank integrally provided for the head itself.

Also, it is preferable to provide the recording head recovery means and preliminarily auxiliary means additionally as constituents of the recording apparatus according to the present invention because these additional means will contribute to enabling the effectiveness of the present invention to be more stabilized. To name them specifically, such constituents are capping means for the recording head, cleaning means, compression or suction means, preliminary heating means such as electrothermal transducers or heating elements other than such transducers or the combination of those types of elements. It is also contribute to the effectiveness of the present invention that the preliminary discharge mode is adopted aside from the regular discharging for recording.

Further, as the recording mode of the apparatus, the present invention is extremely effective in applying it not only to a recording mode in which only main color such as black or the like is used, but also to an apparatus having at least one of a multi-color mode with ink of different colors, or a full-color mode using the mixture of the colors, irrespective of whether the recording heads are integrally structured or it is structured by a combination of plural recording heads.

Now, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such that it can be liquefied when the applicable recording signals are given.

In addition, while positively preventing the temperature rise due to the thermal energy by the use of such energy as an energy consumed for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese Patent Laid-Open Application No. 54-56847 or 60-71260 in order to enable the ink to face the electrothermal transducers. In the present invention, the most effective method for the various kinds of ink mentioned above is the one capable of implementing the film boiling method as described above.

Furthermore, as the mode of the recording apparatus according to the present invention, it may be possible to adopt a copying apparatus combined with a reader in addition to the image output terminal which is integrally or independently provided for a word processor, computer, or other information processing apparatus, and further, it may be possible to adopt a mode of a facsimile apparatus having transmission and reception functions.

What is claimed is:

1. A recording apparatus having a recording head for enabling ink to adhere to a recording medium, and an ink container for containing the ink to be supplied to said recording head for enabling the ink to adhere to said recording medium in accordance with image information data, comprising:

calculating means for calculating an expected amount of the ink to be used in accordance with image information data to be recorded;

ink amount detecting means for detecting the ink amount actually used in recording the image information data; and determining means for determining that there is an abnormality in recording when the ink amount actually used is less than the expected amount of ink to be used by comparing the expected amount of ink to be used, which is calculated by said calculating means, with the ink amount actually used which is detected by said ink amount detecting means.

2. A recording apparatus according to claim 1, further comprising storage means for storing information regarding the ink amount calculated by said calculating means and detected by said ink amount detecting means.

3. A recording apparatus according to claim 1, wherein said recording head is provided with discharging ports for discharging the ink and thermal energy generating elements which generate thermal energy for discharging the ink, and enables the ink to be discharged from said discharging ports by utilizing changes of state created in the ink by the thermal energy generated by said thermal energy generating elements.

4. A method for determining whether or not there is any abnormality in an image recorded by a recording apparatus having a recording head for enabling ink to adhere to a recording medium, and an ink container for containing the ink to be supplied to said recording head for enabling the ink to adhere to said recording medium in accordance with image information data, comprising the steps of:

calculating an expected amount of the ink to be used in accordance with image information data to be recorded;

detecting an ink amount actually used in recording the image information data; and determining that there is an abnormality in recording when the ink amount detected in said detecting step is less than the amount calculated in said calculating step by comparing the expected amount of ink to be used, which is calculated in said calculating step, with the ink amount actually used, which is detected in said detecting step.

5. An ink jet recording apparatus having a recording head for enabling ink to adhere to a recording medium, and an ink container for containing the ink to be supplied to said recording head for enabling the ink to adhere to said recording medium in accordance with image information data, comprising:

calculating means for calculating an expected amount of ink to be used in accordance with image information data to be recorded;

ink amount detecting means for detecting an ink amount actually used in recording the image information data;

recovery processing means for processing recovery of the ink discharging condition of said recording head;

determining means for determining that there is an abnormality in recording when the ink amount actually used is less than the expected amount of ink to be used by comparing the expected amount of ink to be used, which is calculated by said calculating means, with the ink amount actually used, which is detected by said ink amount detecting means; and controlling means for determining whether or not there is any possibility of the recovery of ink discharging condition by use of said recovery processing means, wherein said determining means determines that there is an abnormality in the recorded image, said controlling means actuates said recovery processing means if said controlling means determines that there is a possibility of recovery, and then, resuming the image recording, and wherein said controlling means does not actuate said recovery processing means nor execute the image recording if said controlling means determines that there is no possibility of the recovery.

6. A recording apparatus according to claim 5, further comprising storage means for storing information regarding the ink amount calculated by said calculating means and detected by said ink amount detecting means.

7. A recording apparatus according to claim 5, wherein said recording head is provided with discharging ports for discharging the ink and thermal energy generating elements which generate thermal energy for discharging the ink, and enables the ink to be discharged from said discharging ports by utilizing changes of state created in the ink by the thermal energy generated by said thermal energy generating elements.

8. An ink jet recording method for recording on a recording medium by discharging ink from discharging ports in accordance with image information data using a recording head provided with discharging ports for discharging ink to said recording medium and an ink container for containing the ink to be supplied to said recording head, comprising the steps of:

calculating an expected amount of ink to be used for discharging the ink from said discharging ports in accordance with image information data to be recorded;

detecting an ink amount actually used in recording the image information data;

determining that there is an abnormality in recording when the ink amount detected in said detecting step is less than the amount calculated in said calculating step by comparing the expected amount of ink to be used, which is calculated in said calculating step, with the ink amount actually used, which is detected in said detecting step;

determining whether or not there is any possibility of recovery of the ink discharging condition said recording head by application of the recovery processing when it is determined that there is an abnormality in said image; and resuming the image recording after executing said recovery processing if it is determined that there is said possibility, and not executing said recovery processing if it is determined that there is no possibility nor executing any image recording.

* * * * *

UNITED STATES PATENT AND TRADEMARK OFFICE

CERTIFICATE OF CORRECTION

PATENT NO. : 5,519,418 Page 1 of 4

DATED : May 21, 1996

INVENTOR(S) : Naoyuki NISHIKAWA, et al.

It is certified that error appears in the above-indentified patent and that said Letters Patent is hereby corrected as shown below:

ON THE TITLE PAGE:

Item [56] REFERENCES CITED - FOREIGN PATENT DOCUMENTS:

"1120352 5/1989 Japan
1195049 8/1989 Japan
1290431 11/1989 Japan" should read

--1-120352 5/1989 Japan
1-195049 8/1989 Japan
1-290431 11/1989 Japan--;

"3-240058 11/1991 Japan" should read 3-246058 11/1991 Japan--; and

"4007158 1/1992 Japan" should read
--4-007158 1/1992 Japan--.

COLUMN 2:

Line 9, "determine" should read --determining--;

UNITED STATES PATENT AND TRADEMARK OFFICE

CERTIFICATE OF CORRECTION

PATENT NO. : 5,519,418

DATED : May 21, 1996

INVENTOR(S) : Naoyuki NISHIKAWA, et al.

It is certified that error appears in the above-indentified patent and that said Letters Patent is hereby corrected as shown below:

Line 13, "control" should read --controlling--;
Line 30, "or-not" should read --or not--.

COLUMN 4:

Line 10, "shown" should read --showing--;
Line 34, "invention. (Description" should read --invention.-- and --(Description-- should begin a new line.

COLUMN 5:

Line 65, "easier. (Description" should read --easier.-- and --(Description-- should begin a new line.

COLUMN 7:

Line 24, "like. (Description" should read --like.-- and --(Description-- should begin a new line.

UNITED STATES PATENT AND TRADEMARK OFFICE

CERTIFICATE OF CORRECTION

PATENT NO. : 5,519,418

DATED : May 21, 1996

INVENTOR(S) : Naoyuki NISHIKAWA, et al.

It is certified that error appears in the above-indentified patent and that said Letters Patent is hereby corrected as shown below:

COLUMN 8:

Line 46, "transfer" should read --transfers--.

COLUMN 10:

Line 25, "defective." should read --defects.--.

COLUMN 12:

Line 24, "defectives" should read --defects--;
Line 26, "defectives" should read --defects--.

COLUMN 13:

Line 53, "let" should read --jet--.

COLUMN 14:

Line 19, "the" (second occurrence) should be deleted;

UNITED STATES PATENT AND TRADEMARK OFFICE

CERTIFICATE OF CORRECTION

PATENT NO. : 5,519,418 Page 4 of 4

DATED : May 21, 1996

INVENTOR(S) : Naoyuki NISHIKAWA, et al.

It is certified that error appears in the above-indentified patent and that said Letters Patent is hereby corrected as shown below:

Line 47, "assemble;" should read --assembly;--;
Line 60, "contribute" should read --a contribution--.

COLUMN 15:

Line 60, "used" should read --used,--.

COLUMN 18:

Line 6, "condition" should read --condition of--;
Line 13, "nor" should read --for--.

Signed and Sealed this

Twenty-ninth Day of October 1996

Bruce Lehman

*Attest:*

BRUCE LEHMAN

*Attesting Officer*

*Commissioner of Patents and Trademarks*